US006211132B1

(12) United States Patent
Pierce et al.

(10) Patent No.: US 6,211,132 B1
(45) Date of Patent: Apr. 3, 2001

(54) COMPOSITION AND METHOD FOR DEBURRING/DEGREASING/CLEANING METAL SURFACES

(75) Inventors: John R Pierce, Huntington Woods; Lawrence R Carlson, Waterford; William J Wittke, Clarkston, all of MI (US)

(73) Assignee: Henkel Corporation, Gulph Mills, PA (US)

( * ) Notice: Subject to any disclaimer, the term of this patent is extended or adjusted under 35 U.S.C. 154(b) by 0 days.

(21) Appl. No.: 09/319,904

(22) PCT Filed: Dec. 4, 1997

(86) PCT No.: PCT/US97/21405

§ 371 Date: Jun. 14, 1999

§ 102(e) Date: Jun. 14, 1999

(87) PCT Pub. No.: WO98/26034

PCT Pub. Date: Jun. 18, 1998

Related U.S. Application Data

(60) Provisional application No. 60/033,155, filed on Dec. 13, 1996.

(51) Int. Cl.[7] ..... C11D 1/72; C11D 3/08

(52) U.S. Cl. ..... 510/365; 510/245; 510/255; 510/258; 510/265; 510/420; 510/421; 134/2; 134/40

(58) Field of Search ..... 510/321, 475, 510/507, 245, 255, 258, 265, 304, 325, 338, 365, 376, 392, 421, 420; 134/2, 40; 148/247, 18

(56) References Cited

U.S. PATENT DOCUMENTS

| | | | | |
|---|---|---|---|---|
| 4,485,027 | * | 11/1984 | Rossman et al. | 252/90 |
| 5,391,234 | * | 2/1995 | Murphy | 134/38 |
| 5,736,495 | * | 4/1998 | Bolkan et al. | 510/202 |
| 5,747,439 | * | 5/1998 | Dunn et al. | 510/255 |
| 5,834,411 | * | 11/1998 | Bolkan et al. | 510/245 |
| 5,902,415 | * | 5/1999 | Dunn et al. | 134/42 |

FOREIGN PATENT DOCUMENTS

408133911A * 5/1996 (JP) .

* cited by examiner

*Primary Examiner*—Yogendra Gupta
*Assistant Examiner*—Gregory E. Webb
(74) *Attorney, Agent, or Firm*—Wayne C. Jaeschke; Stephen D. Harper; Norvell E. Wisdom, Jr.

(57) ABSTRACT

An acidic aqueous liquid composition for deburring/degreasing/cleaning metal, in particular aluminum, parts by mass finishing has as its active ingredients: (A) a nonionic surfactant containing halogen atoms, (B) nitrogen based surfactants such as n-alkyl pyrrolidone, builders such as silicates and boric acid, hydrotropes, corrosion inhibitors, and sequestering agents.

20 Claims, No Drawings

COMPOSITION AND METHOD FOR DEBURRING/DEGREASING/CLEANING METAL SURFACES

CROSS-REFERENCE TO RELATED APPLICATION

Priority under 35 U.S.C. §119(e) is claimed for this application from application Ser. No. 60/033,155 filed on Dec. 13, 1996.

BACKGROUND OF THE INVENTION

1. Field of the Invention

The invention relates to a process for simultaneously deburring, degreasing, and cleaning metal surfaces, especially aluminum and aluminum alloy metal surfaces, by mass finishing in the presence of a suitable aqueous liquid composition.

2. Statement of Related Art

Mass finishing is a process of edge and surface finishing a plurality of workpiece components in which the workpiece components are placed together in a container with a plurality of a distinct type of consumable components known as "media". The latter are usually abrasives, either solid ones or abrasive particles in a matrix of some kind, but may also be constituted of other materials for special purposes. In the type of mass finishing of interest in this specification, a liquid aqueous composition is also used in the same container as the workpieces and the media. After all three components have been introduced into the container, mechanical means are then used to cause relative motion between the media and the workpieces. More details are given in various standard references, such as J. B. Higneft, "Mass Finishing", *Metal Finishing, 53rd Guidebook-Directory Issue* 1985 (Metals and Plastics Publications, Inc., Hackensack, N.J., 1985), pp. 77–98.

DESCRIPTION OF THE INVENTION

Object of the Invention

A major object of the invention is to provide an aqueous liquid composition and process that, when used in mass finishing, particularly of aluminum and aluminum alloy workpieces, will achieve at least one of the following improvements over current mass finishing processes: better degreasing; better cleaning of other types of soils from the surfaces; better deburring, and brighter (i.e., more reflective) and/or smoother surface finishes of the workpieces, with the word "better" being understood to include any or all of (i) obtaining equal workpiece surface quality in a shorter time, (ii) better workpiece surface quality, and (iii) improved process results not directly related to workpiece quality, such as lower foaming and lower levels of polluting byproducts. Other concurrent or alternative objects are to provide a more economical process and/or a process requiring less expensive equipment for operation on a large scale.

General Principles of Description

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. Also, unless expressly stated to the contrary: percents, "parts of", fractions, ratio values, and the like are by weight; the term "polymer" includes "oligomer", "copolymer", "terpolymer", and the like; the description of a group or class of materials as suitable or preferred for a given purpose in connection with the invention implies that mixtures of any two or more of the members of the group or class are equally suitable or preferred; description of electrically neutral constituents in chemical terms refers to the constituents at the time of addition to any combination specified in the description and/or at the time of formation within such a combination by known chemical reactions as specified in the description, and does not necessarily preclude other chemical interactions among the constituents of a mixture once mixed; specification of materials in ionic form implies the presence of sufficient counterions to produce electrical neutrality for the composition as a whole (any counterions thus implicitly specified should preferably be selected from among other constituents explicitly specified in ionic form, to the extent possible; otherwise such counterions may be freely selected, except for avoiding counterions that act adversely to the objects of the invention); and the term "mole" and its variations may be applied to elemental, ionic, and any other chemical species defined by number and type of atoms present, as well as to compounds with well defined molecules.

Also, unless the context requires otherwise to be sensible or there is an express contrary indication, such as the use of the qualifier "pure" or the like, the term "aluminum" when used hereinafter to describe a substrate being treated by or suitable to be treated by a process according to this invention is to be understood to include pure aluminum and all the alloys of aluminum that contain at least 55% of pure aluminum.

SUMMARY OF THE INVENTION

The working and concentrate metal deburring/degreasing/cleaning compositions of the invention comprise, preferably consist essentially of, or more preferably consist of, water and the following dissolved, stably dispersed, or both dissolved and stably dispersed components:

(A) a surfactant component including at least one member selected from the group consisting of:

(A.1) nonionic surfactant molecules, exclusive of amine oxide molecules, that contain a moiety conforming to the general chemical formula: $—(C_mH_{(2m-z)}X_zO)_v—$, wherein m has the value 2, 3, or 4, preferably 2 or 3, more preferably 2; z represents an integer with a value from 0 to 2m; X represents a halogen atom, and if z has a value of more than 1, may represent the same or a different halogen atom for each X; and v represents a positive integer; and (A.2) anionic, amphoteric, and both anionic and amphoteric surfactants, exclusive of any previously recited components, that are alkali stable;

(B) a component selected from the group consisting of molecules, exclusive of molecules that are part of component (A), that include a moiety corresponding to general chemical formula I:

(I)

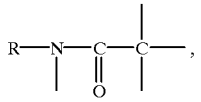

where R represents a monovalent aliphatic, preferably straight chain, moiety with the chemical formula $—C_nH_{(2n+1-y)}F_y$, wherein n is an integer from 6 to 22, and y is an integer from 0 to (2n+1); and, optionally, one or more of the following components:

(C) a component of pH control agent(s), often alternatively known in the detergent art as "builder(s)", that are not part of any of the previously recited components;

(D) a component of organic compound(s) that (1) are not part of any of the previously recited components, (2) are liquid at 25° C., and (3) are selected from the group consisting of (3.1) compounds made up of molecules that (3.1.1) contain at least two hydroxyl oxygen atoms and (3.1.2) otherwise contain (3.1.2.1) only carbon and hydrogen and, optionally, halogen atoms, or preferably (3.1.2.2) only carbon and hydrogen atoms; and (3.2) compounds made up of molecules that (3.2.1) contain at least two ether oxygen atoms and (3.2.2) otherwise contain (3.2.2.1) only carbon, hydrogen, hydroxyl oxygen, and/or halogen atoms, or preferably (3.2.2.2) only carbon and hydrogen atoms and, optionally, not more than one hydroxyl oxygen atom; and (E) a component of hydrotroping agent that is not part of any of the previously recited components;

(F) a component of corrosion inhibitors that are not part of any of the previously recited components; and (G) a component of sequestering agents that are not part of any of the previously recited components.

In this description, "stably dispersed" means that the component so described can be dispersed by mixing, within one hour of its introduction into the liquid phase in which the component in question is described as stably dispersed, to produce a liquid mixture which has only one bulk phase detectable with unaided normal human vision and does not spontaneously develop any separate bulk phase detectable with normal unaided human vision within 24 hours, or preferably, with increasing preference in the order given, within 7, 30, 60, 90, 120, 180, 240, 300, or 360 days, of storage without mechanical agitation at 25° C. after being initially mixed. (The word "bulk" in the preceding sentence means that, to be considered as a bulk phase, a phase must occupy at least one volume of space that is sufficiently large to be visible with unaided normal human vision and is separated from at least one other phase present in the dispersion by a boundary surface that can be observed with unaided normal human vision. Therefore, a change of the composition from clear to hazy or from hazy to clear does not indicate instability of a dispersion within this definition, unless a separate liquid or solid phase develops in the mixture in at least one volume large enough to see independently with unaided normal human vision.) Also in this description, "alkali stable" when referring to a surfactant means that the surfactant is capable of coexisting at its critical micelle concentration in an aqueous solution also containing at least, with increasing preference in the order given, 5, 10, 15, 20, 25, or 29% of sodium hydroxide, without any chemical reaction (except possibly for reversible neutralization) between the surfactant and the sodium hydroxide and without the formation of any separate bulk phase detectable with normal unaided human vision within 24 hours, or preferably, with increasing preference in the order given, within 7, 30, 60, 90, 120, 180, 240, 300, or 360 days, of storage without mechanical agitation at 25° C. after being initially mixed.

Compositional embodiments of the invention include liquid compositions ready for use as such in cleaning (i.e., "working compositions") and concentrates suitable for preparing working compositions by dilution with water. Some compositions may be suitable for both uses. Concentrates may be single package or multiple, usually dual, package in nature. A multiple package type of concentrate is preferred when not all of the ingredients desired in the working composition are sufficiently soluble or stably dispersible at the higher concentrations required for a one package concentrate composition, which is otherwise preferred. For example, at some concentrations, preferred polymeric organic sequestering agents and some preferred alkalinizing components can not be jointly solubilized. The two components are then placed in separate packages with other portions of the formulation so that stable solutions or dispersions can be formed after mixing and dilution. A two package concentrate system has some advantages in that the two components can be mixed in different proportions to provide more effective cleaning for particular soils, soil combinations, and/or types of substrate to be cleaned. Ordinarily, however, at least for users for whom cleaning requirements do not vary greatly, single package concentrates are preferred because they are more convenient.

Process embodiments of the invention include at a minimum using a working composition according to the invention to remove soils from a metal substrate during mass finishing, and they may include other process steps, particularly those which are conventional in themselves, preceding or following combined cleaning and mass finishing in the prior art.

Compositions of the present invention are particularly useful for deburring/degreasing/cleaning substrates with surfaces of aluminum and aluminum alloys containing at least 55% by weight of aluminum, but are also useful for articles fabricated from metals such as steel, stainless steel, magnesium, titanium, tantalum, and any other metals which are machined or worked during their fabrication into useful articles.

In addition to the above noted necessary and optional materials, compositions of the present invention can additionally contain germicides, preserving agents and the like.

A composition of the present invention does not generally require the presence of a foam suppressing agent. All of the preferred types of surfactants in a composition according to the invention are readily available commercially in relatively low foaming embodiments. It is generally preferred to prepare the deburring/degreasing/cleaning compositions from low-foaming or moderate-foaming surfactant materials, rather than using surfactants known to be high foaming and adding a foam suppressing agent. The use of separate foam suppressing agents, however, is within the broad scope of the invention.

DESCRIPTION OF PREFERRED EMBODIMENTS

Working compositions and processes according to this invention are effective over a wide range of pH values. For primary deburring/degreasing/cleaning prior to most subsequent operations, an alkaline working composition according to the invention is often preferred because it generally effects adequate deburring/degreasing/cleaning more rapidly. The particular degree of alkalinity that is most preferred generally requires a compromise between quick deburring/degreasing/cleaning, which is favored by greater alkalinity, and minimizing corrosion, which, at least for aluminum substrates, is favored by lower alkalinity. The presence of silicates in a working composition according to the invention is very advantageous in reducing corrosion at higher alkalinity levels, as noted in further detail below, but silicates often leave a slight surface residue which is unimportant for some types of further processing but unacceptable for others.

For deburring/degreasing/cleaning objects of aluminum alloys intended for manufacture of aerospace vehicles, very low corrosion by the deburring/degreasing/cleaning composition is required and the presence of silicates is acceptable, inasmuch as any residue that they may leave is removed by and/or is harmless in the further processing that such deburred/degreased/cleaned objects undergo. For these aerospace industry applications of the invention when rapid deburring/degreasing/cleaning is desired, the pH of a working composition according to the invention preferably is at least, with increasing preference in the order given, 9.3, 9.5, 9.7, 9.9, 10.1, 10.3, 10.5, 10.7, 10.9, 11.0, 11.1, 11.2, or 11.3 and independently preferably is, with increasing preference in the order given, not more than 12.0, 11.9, 11.8, or 11.7. For other applications where the presence of silicates in the working compositions is acceptable and corrosion minimization is less important than in aerospace applications, pH values up to at least 12.7 are satisfactory and may be preferred for working compositions because they effect relatively rapid deburring/degreasing/cleaning.

If silicate residues on the deburred/degreased/cleaned metal surfaces are not acceptable and the metal surface being deburred/degreased/cleaned is predominantly aluminum, the pH of a working composition preferably is not more than, with increasing preference in the order given, 8.9, 8.8, 8.7, 8.6, or 8.5, because at higher pH values corrosion of the deburred/degreased/cleaned aluminum object is likely to be higher than desirable. In order to minimize corrosive attack, even working compositions with a mildly acidic pH may be advantageously used to degrease many aluminum substrates, and in one particular specialized embodiment of the invention in which silicates are not included in the compositions according to the invention in order to minimize residues and/or promote high final surface brightness, the pH of a working composition preferably is, with increasing preference in the order given, at least 3.0, 3.5, 3.8, 4.0, 4.2, 4.4, 4.6, 4.70, 4.80, 4.90, 5.00, 5.10, 5.20, or 5.28 and independently preferably is, with increasing preference in the order given, not more than 7.1, 6.9, 6.7, 6.5, 6.3, 6.1, 5.9, 5.70, 5.50, 5.40, or 5.32. These embodiments of the invention are particularly useful for deburring/degreasing/cleaning aluminum alloy die castings, such as those used in the marine motor industry.

Subcomponent (A.1) when used preferably is selected from the group consisting of: (A.1.1) (A.1.1.1) block copolymers of propylene oxide and ethylene oxide, (A.1.1.2) ethoxylated and both ethoxylated and propoxylated fatty alcohols, (A.1.1.3) ethoxylated and both ethoxylated and propoxylated alkyl phenols, and (A.1.1.4) ethoxylated alkyl or aryl moieties, all of which constituents of sub-subcomponent (A.1.1) optionally can be modified by capping the terminal ethoxy or propoxy group with a low molecular weight capping moiety generally having 1 to 4 carbon atoms; (A.1.2) neutral esters of a fatty acid and/or fatty alcohol that include a polyoxyethylene block in their molecular structure; (A.1.3) ethoxylated fatty amines; and (A.1.4) ethoxylated monoglycerides and diglycerides. Preferably, the nonionic surfactants utilized in the practice of the present invention are stable and soluble in the working compositions that contain them. Independently, these nonionic surfactants more preferably are selected from molecules conforming to the general formula $R^4$—$(C_2H_4O)_w$—$R^5$, where $R^4$ represents an alkyl, aryl, or alkylaryl moiety preferably having at least, with increasing preference in the order given, 5, 6, 7, 8, or 9 carbon atoms and independently preferably having not more than, with increasing preference in the order given, 22, 20, 18, 16, 14, 13, or 12 carbon atoms; $R^5$ represents hydrogen or an alkyl, aryl, or alkylaryl group having no more than, with increasing preference in the order given, 8, 6, 4, 3, 2, or 1 carbon atom(s); and w is a number having an average value that is at least, with increasing preference in the order given, 4.0, 5.0, 6.0, 7.0, 8.0, or 8.7 and independently preferably is not more than, with increasing preference in the order given, 14.0, 13.0, 12.0, 11.0, 10.0, 9.6, or 9.3. Each of the $R^4$ and $R^5$ moieties independently more preferably is an alkyl moiety, without any aryl groups, and independently more preferably is primary (i.e., has two hydrogen and/or halogen atoms bonded to the carbon atom in the moiety with the free valence) and independently more preferably has no substituent groups, although it may have halogen or ether substituent groups within the broad scope of the invention, except that the most preferred $R^5$ moiety is hydrogen.

Independently of other preferences, subcomponent (A.1) when used preferably is selected from surfactants with a hydrophile-lipophile balance (hereinafter usually abbreviated as "HLB") value that is not less than, with increasing preference in the order given, 9.6, 10.0, 10.4, 10.8, 11.2, 11.6, 11.8, 12.0, 12.2, or 12.4 and independently preferably is not more than, with increasing preference in the order given, 16, 15.0, 14.6, 14.2, 13.8, 13.6, 13.4, or 13.3. Suitable commercially available nonionic surfactants with an HLB within this range for use in subcomponent (A.1) as defined above include materials such as MACOL™ OLA4; ALKASURF™ LA-EP45; CHEMAL™ LA-9; FLO MOT™ 6 D; PLUR-OFAC™ R AR20; ALKASURF™ OP-5; TRITON™ DF-12, N-87, and DF-18; ALKAMUL™ 400 MO; TERGITOL™ TMN-6; PLURONIC™ L43; and NEODOL™ 25-7, 1-73B, 91-8; and the like.

Subcomponent (A.2) when used preferably is selected from the group consisting of Alkali Surfactant JEN 2700™, commercially supplied by Tomah Chemical Products, Milton, Wisconsin and reported by its supplier to be a solution in water of about 35% of its surfactant ingredient, mono sodium salt of iso-decyloxypropylaminodipropionic acid, an amphoteric surfactant, and SURMAX™ CS-504, -515, -521, -522, -555, -586, -634, -684, -727, -772, and -786 surfactants, all commercially available from Chemax, Inc., Greenville, S.C. and reported by their supplier to be amphoteric-anionic alkali stable surfactants that include organic esters, and/or salts of organic esters, of phosphoric acid, with other compositional information being proprietary.

Independently, a composition according to the invention preferably contains both subcomponents (A.1) and (A.2) in a ratio of (A.2) to (A.1) that is at least, with increasing preference in the order given, 0.02:1.0, 0.04:1.0, 0.06:1.0, 0.08:1.0, 0.10:1.0, 0.12:1.0, 0.14:1.0, 0.160:1.0, 0.170:1.0, 0.180:1.0, or 0.190:1.0 and independently preferably is not more than, with increasing preference in the order given, 1.0:1.0, 0.80:1.0, 0.60:1.0, 0.40:1.0, 0.30:1.0, 0.25:1.0, or 0.20:1.0.

In a concentrate composition according to the invention, the total amount of component (A) preferably is at least, with increasing preference in the order given, 25, 35, 40, 45, 50, 55, 60, 65, 70, 75, 80, 85, 90, 95, 100, 105, 110, 115, 120, or 125 grams per kilogram of total composition (hereinafter usually abbreviated "g/kg"), and independently preferably is not more than, with increasing preference in the order given, 500, 400, 350, 300, 275, 250, 225, 200, 185, 175, 165, or 160 g/kg.

In general, in a working composition according to the invention, the concentration of any component (except water) for which a preferred concentration in a concentrate composition is specified herein is preferably at least, with increasing preference in the order given, 0.002, 0.004, 0.006, 0.008, 0.010, 0.015, 0.020, or 0.025 times the concentration specified for the same component in the concentrate composition and independently, primarily for reasons of economy, preferably is not more than, with increasing preference in the order given, 0.15, 0.10, 0.090, 0.080, 0.070, 0.060, 0.050, 0.045, 0.040, or 0.035 times the concentration specified for the same component in the concentrate composition. For example, in a working composition, the concentration of component (A) preferably is at least, with increasing preference in the order given, 0.75, 1.05, 1.20, 1.35, 1.50,1.65, 1.80,1.95, 2.10, 2.25, 2.40, 2.55, 2.70, 2.85, 3.00, 3.15, 3.30, 3.45, 3.60, or 3.75 g/kg and independently preferably is not more than, with increasing preference in the order given, 15.0, 12.0, 10.5, 9.0, 8.25, 7.50, 6.75, 6.00, 5.55, 5.25, 4.95, or 4.80 g/kg However, for any actual concentrate composition according to the invention, working compositions made by diluting the actual concentrate composition so as to provide any amount of the actual concentrate composition in the range of 1 to 20% of the concentrate composition in the working compositions may be most preferable for a specific application, with lower amounts of the concentrate, within this range, being generally satisfactory and more economical in a working composition when relatively low volumes of soils are to be removed, and larger amounts of the concentrate composition, within this range, being more likely to be needed in a working composition to remove heavy soil loads in an economically acceptable time.

Component (B) as specified above preferably is selected from molecules in which the nitrogen and carbon atoms in the moiety according to formula (I) are all part of a five or six membered ring structure, more preferably from the group of N-alkyl-2-pyrrolidones in which the alkyl group is more preferably straight chain and independently preferably has, with increasing preference in the order given, at least 2, 3, 4, 5, 6, 7, or 8 carbon atoms and also independently preferably has, with increasing preference in the order given, not more than 30, 20, 18, 16, 14, 12, 11,10, or 9 carbon atoms.

In a concentrate composition according to the invention, the concentration of component (B) preferably is at least 0.5, 1.0,1.5, 2.0, 2.5, 3.0, 3.5, 4.0, 4.3, 4.6, or 4.9 g/kg of concentrate and independently preferably is not more than, with increasing preference in the order given, 100, 60, 40, 35, 30, 25, 20, 15, 10, 9.0, 8.0, 7.5, 7.0, 6.5, 6.0, 5.7, 5.4, or 5.1 g/kg. Also, independently, the ratio of the concentration of component (B) to the concentration of component (A) preferably is at least, with increasing preference in the order given, 0.004:1.0, 0.008:1.0, 0.012:1.0, 0.016:1.0, 0.020:1.0, 0.024:1.0, 0.028:1.0, 0.032:1.0, 0.0340:1.0, 0.0350:1.0, 0.0360:1.0, 0.0370:1.0, 0.0380:1.0, or 0.0390:1.0 and independently preferably is, primarily for economic reasons, not more than, with increasing preference in the order given, 0.50:1.0, 0.35:1.0, 0.20:1.0, 0.15:1.0, 0.100:1.0, 0.090:1.0, 0.080:1.0, 0.070:1.0, 0.060:1.0, 0.050:1.0, 0.045:1.0, or 0.041:1.0 When present in a composition according to the invention, as is preferred, pH adjusting component (C) is preferably selected from various inorganic acids, salts, and hydroxides known to be useful as "inorganic builders" in cleaning formulations generally. Inorganic builder salts are generally salts of polyfunctional inorganic acids, such as alkali metal silicates, alkali metal borates, alkali metal carbonates, alkali metal sulfates, alkali metal polyphosphates, alkali metal phosphates, alkali metal orthophosphates, and alkali metal pyrophosphates. Salts such as sodium silicate, sodium metasilicate, sodium orthosilicate, sodium tetraborate, sodium borate, sodium sulfate, sodium carbonate, trisodium phosphate, disodium orthophosphate, sodium metaphosphate, sodium pyrophosphate, and the equivalent potassium salts and sodium and potassium hydroxides and the like are all suitable pH adjusting agents for compositions according to the present invention. Lithium, rubidium, and cesium salts and hydroxides are also suitable, although usually less preferred because of their higher cost, and ammonium salts are technically suitable but are generally avoided because of the chance of loss by volatilization and the accompanying odor nuisance of ammonia fumes.

For the specific embodiment of this invention in which an acidic pH value is preferred, subcomponent (C) preferably comprises, more preferably consists essentially of, or still more preferably consists of a mixture of (C. 1) alkali metal salts of a boric acid or condensed boric acid and (C.2) free boric acid or condensed boric acid. Orthoboric acid (i.e., $H_3BO_3$) is preferred, and independently potassium salts are preferred over those of the other alkali metals, with sodium next most preferred. Subcomponent (C.1) may conveniently be, and usually preferably is, supplied by adding the appropriate boric acid in an amount in excess of that finally desired in the composition and neutralizing the desired fraction of it with an alkali metal oxide, carbonate, and/or hydroxide, which for purposes of calculation of preferred amounts herein is assumed to neutralize all of the hydrogen atoms in each boric acid molecule, to the extent stoichiometrically possible with the amount of alkali metal oxide, carbonate, and/or hydroxide added. The concentration of subcomponent (C.1) in a concentrate composition according to the invention preferably is at least, with increasing preference in the order given, 20, 30, 40, 50, 60, 70, 80, 90, 100, 110, 120, 130, 140, 150, 155, or 160 millimoles per kilogram of total composition (hereinafter usually abbreviated as "mM/kg") and independently preferably is not more than, with increasing preference in the order given, 2.0, 1.5, 1.0, 0.90, 0.80, 0.70, 0.60, 0.50, 0.40, 0.30, 0.25, 0.20, 0.190, 0.180, or 0.170 moles per kilogram of total composition (hereinafter usually abbreviated as "M/kg").

Subcomponent (C.2) is preferably the same acid or mixture of acids the salts of which constitute subcomponent (C.1). For purposes of calculating preferred amounts, the effective amount of subcomponent (C.2) is assumed to exclude any amount added which would be assumed to be neutralized as described in the immediately preceding paragraph. The amount of subcomponent (C.2) preferably is such that the molar ratio of the effective amount of subcomponent (C.2) to the amount of subcomponent (C.1) present in a composition according to the invention is at least, with increasing preference in the order given, 0.3:1.0, 0.5:1.0, 0.60:1.0, 0.70:1.0, 0.80:1.0, 0.90:1.0, 1.00:1.0, 1.10:1.0, 1.20:1.0, or 1.25:1.0 and independently preferably is not more than, with increasing preference in the order given, 8:1.0, 6:1.0, 5.0:1.0, 3.0:1.0, 2.5:1.0, 2.1:1.0, 1.9:1.0, 1.7:1.0, 1.60:1.0, 1.50:1.0, 1.40:1.0, 1.35:1.0, or 1.30:1.0.

Optional solvent component (D) is not ordinarily needed in a composition according to this invention and if not needed is preferably omitted, inasmuch as the extents of emission into the natural atmosphere of most of the chemical substances meeting the criteria for this component are legally restricted. However, in some specialized uses, such solvents may be needed for satisfactory results.

Optional hydrotroping component (E) also is not generally needed in most compositions according to this invention, in part because many of the preferred constituents of component (A) have some hydrotroping effect. Conventional hydrotroping agents such as the salts of alkyl benzene sulfonic acids, particularly of cumene sulfonic acid, are suitable for compositions to accomplish the cleaning purposes of this invention, but should not be used for many aerospace applications because of very low tolerances for residual sulfur on the surface that are specified for such applications. Two other types of hydrotropes are therefore preferred, when an additional hydrotrope is needed, for most formulations according to this invention: (i) organic phosphate esters and (ii) alkyl and alkenyl substituted cyclic acid anhydrides, particularly the anhydrides of $C_{4-6}$ terminal dicarboxylic acids substituted with alkyl or alkenyl groups having 6 to 20 carbon atoms. A particularly preferred example of this type of hydrotrope is nonenyl succinic anhydride. These two types are even more preferred in combination with each other, in a ratio of type (i) to type (ii) that preferably is, with increasing preference in the order given, at least 0. 1, 0.2, 0.4, 0.6, 0.80, 0.90, 1.00, 1.10, 1.20, 1.30, 1.40, 1.50, or 1.55 and independently preferably is, with increasing preference in the order given, not more than 20, 15, 10, 7, 5, 4, 3, 2.7, 2.4, 2.2, 2.0, 1.9, 1.8, 1.75, 1.70, or 1.65. The amount of hydrotroping agent is not believed to be critical, but in a highly alkaline concentrate with other components at their most preferred levels, the total amount of hydrotroping agent preferably is, with increasing preference in the order given, at least 5, 25, or 50 g/L and independently preferably is, with increasing preference in the order given, not more than 150, 90, or 70 g/L. In working compositions or in concentrates of lower pH, no hydrotroping agent at all is usually needed, although the presence of one has not been observed to cause any harm.

The presence of a corrosion inhibiting effective amount of component (F) in a composition according to the invention is often but not always preferred. Essentially any organic material known to have a corrosion inhibiting effect on aluminum may be utilized in optional component (F) according to the invention as described above. The organic corrosion inhibitors most useful in the practice of the present invention are generally nitrogen or oxygen containing organic compounds, such as amines, nitro compounds, imidazoles, diazoles, triazoles, carboxylic acids, and the like. Particularly preferred organic inhibitors are aromatic triazoles and their salts. When component (F) is present in a concentrate composition according to this invention and is selected from these organic materials, its concentration preferably is, with increasing preference in the order given, at least 0.001, 0.002, 0.004, 0.008, 0.015, 0.030, 0.060, 0.12, 0.25, 0.35, 0.40, 0.45, 0.48, 0.52, 0.55, or 0.58 g/L and independently, primarily for reasons of economy, preferably is, with increasing preference in the order given, not more than 20, 10, 5, 4.5, 4.0, 3.6, 3.2, 2.8, 2.4, 2.0, 1.9, 1.8, 1.7, or 1.6 g/L.

Optional sequestering agent component (G) is not needed or preferable in most compositions according to the invention, but may be useful in certain cases, particularly if the water that forms the bulk of a composition according to the invention is extraordinarily hard and/or a mildly acidic working composition is preferred. Any material recognized in the art as a sequestering agent for aluminum, calcium, and/or magnesium cations in aqueous solution may be used. A particularly preferred type of sequestering agent for one particular embodiment of the invention is a polycarboxylate copolymer of the type generally available commercially and often known as an "organic builder". Materials such as Polymer QR1362-PMN and ACUSOL™ 102, supplied by Rohm and Haas, have been found to be useful for this purpose in the practice of the present invention. In a working composition according to this invention, the concentration of polycarboxylate copolymer, if needed, preferably is, with increasing preference in the order given, at least 0.1, 0.2, 0.4, 0.8, 1.5, 2.0, 2.5, 2.8, 3.1, 3.4, 3.6, 3.7, 3.8, 3.9, 4.0, or 4.1 g/L and independently preferably is, with increasing preference in the order given, not more than 100, 50, 38, 28, 24, 20, 16, 14, 13, 12, or 11 g/L.

Other preferred sequestering agents, for the particular embodiments of the invention in which the pH of a working composition is acidic, include sufficiently water-soluble organic acids, and salts of acids, that contain at least two —OH moieties (which may or may not be part of carboxyl moieties) positioned within the acid molecule in such a way that the two oxygen atoms are separated from each other by at least two carbon atoms. Preferred examples of such acids include nitrilotriacetic acid ("NTA"), ethylene diamine tetraacetic acid ("EDTA"), and, particularly preferred, citric acid. In a concentrate intended for use to prepare working compositions with a pH value not more than 7.0, the number of hydroxyl gram equivalents, including hydroxyl parts of carboxyl groups (in the acid form, even if a salt rather than the corresponding acid is the source of this sequestering agent component), per kilogram of total composition (hereinafter usually abbreviated as "{OH-eq}/kg") preferably is at least 0.05, 0.10, 0.20, 0.30, 0.35, 0.40, 0.45, or 0.50 {OH-eq}/kg and independently preferably is not more than 2.5, 2.0, 1.5, 1.2, 0.9, 0.80, 0.70, 0.65, 0.60, or 0.55 {OH-eq}/kg.

Metal articles to be deburred/degreased/cleaned should be contacted with an aqueous deburring/degreasing/cleaning composition according to the invention and suitable mass finishing media and maintained in motion at a sufficient temperature for a sufficient time to be effective for deburring/degreasing/cleaning. Normal ambient human comfort temperatures of 18 to 25° C. are normally sufficient and, when sufficient, are strongly preferred for convenience, because few of the types of mechanical equipment suitable for mass finishing are equipped for temperature control. For removing average type soils, a time from 2 to 10 minutes is suitable, when using substantially the same mechanical conditions, proportions among media, workpieces, and liquid as are known in the art.

As is well understood in the art, after a deburring/degreasing/cleaning operation, the workpieces can be processed in other usual steps such as alkaline or acid cleaning, deoxidizing, conversion coating, a conversion-coating-improving wash coat or "sealer", such as a chromium wash step, and, if required, the workpieces can be coated with an organic or inorganic protective coating. All of the additional steps are well known in the art and may be required by a particular utility for which the workpieces are intended.

The following examples illustrate the compositions and methods of the present invention. The examples are for illustrative purposes only and are not intended to limit the invention.

CONCENTRATE, WORKING COMPOSITION, AND PROCESS EXAMPLES

The ingredients and amounts of each ingredient used in five concentrate compositions and, in most instances, the pH value of a corresponding working composition, which unless otherwise stated consists of a 20% by volume solution of the concentrate composition in deionized water are shown in Table 1 below.

The N-octyl pyrrolidone used as shown in Table 1 was a commercial product, SURFADONE™ LP-100, from ISP Technologies, Inc., Wayne, N.J. The boric acid used as shown in Table 1 was a commercial product of U.S. Borax, Inc., Rosemont, Ill., reported by its supplier to have a boron content stoichiometrically equivalent to from 99.9 to 100.9% of $H_3BO_3$. The chemical nature and/or commercial sources of the other ingredients in Table 1 that are not identified there or earlier in this

TABLE 1

CONCENTRATE COMPOSITIONS ACCORDING TO THE INVENTION

| Ingredient | Grams of Ingredient per Kilogram of Concentrate | | | | |
|---|---|---|---|---|---|
| | 1 | 2 | 3 | 4 | 5 |
| CHEMAL ™ LA-9 surfactant | 100 | 0 | 100 | 0 | 0 |
| SURMAX ™ CS-684 surfactant | 30 | 0 | 30 | 60 | 24 |
| Alkali Surfactant JEN 2700 ™ | 13 | 0 | 13 | 0 | 0 |
| NEODOL ™ 91-8 surfactant | 0 | 100 | 0 | 200 | 80 |
| NEODOL ™ 1-73B surfactant | 0 | 30 | 0 | 60 | 24 |
| N-octyl-2-pyrrolidone | 10 | 30 | 10 | 12 | 5 |
| Sodium metasilicate pentahydrate | 80 | 80 | 80 | 0 | 0 |
| 45% Solution in water of KOH | 0 | 0 | 0 | 60 | 60 |
| Citric Acid | 0 | 0 | 0 | 26 | 26 |
| Technical granular boric acid | 0 | 0 | 6 | 22 | 22 |
| Deionized Water | Balance in all concentrates | | | | |
| pH of Corresponding Working Composition: | 12 | n.m. | 11.35 | 4.9 | 5.3 |

Abbreviation and Other Note for Table 1
n.m. = not measured; for concentrate 5, the working composition contained 3% of the concentrate.

description were as follows:

NEODOL™ 91-8 and 1-73B surfactants were both commercially supplied by Shell Chemical Co. The former is reported by its supplier to be ethoxylates of linear primary alcohols with from 9 to 11 carbon atoms per molecule before ethoxylation, an average of 8 ethylene oxide residues per molecule after ethoxylation, and an HLB value of 12.5. The latter is reported by its supplier to be a blend of ethoxylates of $C_{11}$ primary alcohol with an overall average of 5.6 ethylene oxide residues per molecule, achieved by blending two separate ethoxylates with average numbers of ethylene oxide residues per molecule of 3 and 7, and to have an overall HLB value of 11.2–12.3.

The sodium metasilicate pentahydrate used was supplied by Van Waters & Rogers of Kirkland, Wash. under the trade name UNIFLO™ 26.

The citric acid used was commercially supplied by Harrmann & Reimer Corp., Elkhart, Ind. and was reported by the supplier to be 100% anhydrous citric acid.

Aqueous solutions of 5, 10, 15, and 20 volume % of each of concentrates 1–3 shown in Table 1 are prepared and tested at ambient temperature for cleaning aluminum workpieces soiled with standardized amounts of ink, lipstick, COSMOLENE™ petroleum jelly, and axle grease. Panels are vibrated or tumbled for 2 to 10 minutes in a container in which mass finishing media, the workpieces, and the working composition are all present. The workpieces are then removed from contact with the working composition according to the invention and the mass finishing media, rinsed with tap water, and examined. Highly effective removal of all the standard soils is achieved. No etching of the aluminum workpieces is observed by visual inspection.

Similarly, aqueous solutions of 1, 3, and 5 volume % of each of concentrates 4 and 5 are prepared and tested in the same manner, except on aluminum workpieces with considerably less soil that includes primarily light oil and fine metal particles. The soil is removed and workpieces after rinsing are clean and bright.

What is claimed is:

1. A liquid composition of matter, suitable as such, after dilution with water, or both as such and after dilution with water, for aiding in the removal of soils from soiled metal workpiece surfaces by mass finishing, said liquid composition comprising water and:

(A) a concentration of a component selected from the group consisting of:

(A.1) nonionic surfactant molecules that contain a moiety with the chemical formula $—(C_mH_{(2m-z)}X_zO)_v—$, wherein m has the value 2, 3, or 4; z represents an integer with a value from 0 to 2m; X represents a halogen atom, and if z has a value of more than 1, may represent the same or a different halogen atom for each X; and v represents a positive integer; and (A.2) anionic, amphoteric, and both anionic and amphoteric alkali stable surfactants;

(B) a concentration of a component selected from the group consisting of molecules, exclusive of molecules that are part of component (A), that include a moiety corresponding to general chemical formula I:

(I)

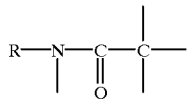

wherein R represents a monovalent aliphatic moiety with the chemical formula $—C_nH_{(2n+1-y)}F_y$, wherein n is an integer from 6 to 22, and y is an integer from C to (2n+1); and (C) one or more alkali metal silicates.

2. A composition according to claim 1, wherein: the concentration of component (A) is at least about 40 g/kg; component (A) includes a concentration of each of subcomponents (A.1) and (A.2), and the concentration of (A.2) has a ratio to the concentration of (A.1) that is from about 0.06:1.0 to about 0.60:1.0; the concentration of component (B) is at least about 1.5 g/kg; and the concentration of component (B) has a ratio to the concentration of component (A) that is from about 0.016:1.0 to about 0.15:1.0.

3. A composition according to claim 2, wherein: subcomponent (A.1) is selected from the group consisting of: (A.1.1) (A.1.1.1) block copolymers of propylene oxide and ethylene oxide, (A.1.1.2) ethoxylated and both ethoxylated and propoxylated fatty alcohols, (A.1.1.3) ethoxylated and both ethoxylated and propoxylated alkyl phenols, and (A.1.1.4) ethoxylated alkyl or aryl moieties, all of which constituents of sub-subcomponent (A.1.1) optionally can be modified by capping a terminal ethoxy or propoxy group with a low molecular weight capping moiety having 1 to 4 carbon atoms; (A.1.2) neutral esters of a fatty acid and/or fatty alcohol that include a polyoxyethylene block in their molecular structure; (A.1.3) ethoxylated fatty amines; and (A.1.4) ethoxylated monoglycerides and diglycerides; the concentration of component (A) is at least about 60 g/kg; the concentration of (A.2) has a ratio to the concentration of (A.1) that is from about 0.10:1.0 to about 0.40:1.0; the concentration of component (B) is at least about 2.5 g/kg; and the concentration of component (B) has a ratio to the concentration of component (A) that is from about 0.024:1.0 to about 0.15:1.0.

4. A composition according to claim 3, wherein: component (B) is selected from the group consisting of N-alkyl- 2-pyrrolidones in which the alkyl group has from 2 to 20 carbon atoms; the concentration of component (A) is at least about 80 g/kg; and the concentration of component (B) has a ratio to the concentration of component (A) that is from about 0.024:1.0 to about 0.090:1.0.

5. A composition according to claim 1 that additionally comprises alkaline inorganic builders selected from the group consisting of alkali metal hydroxides, alkali metal borates, alkali metal carbonates, alkali metal sulfates, alkali metal polyphosphates, alkali metal phosphates, alkali metal orthophosphates, and alkali metal pyrophosphates.

6. A process of deburring/degreasing/cleaning a plurality of solid workpieces having metal surfaces by mass finishing in the presence of an aqueous liquid composition in the same container as the workpieces and solid finishing media, wherein the improvement comprises utilizing a composition according to claim 1, as the aqueous liquid composition.

7. A process according to claim 6 wherein, in the aqueous liquid composition: the concentration of component (A) is from about 1.2 to about 9.0 g/kg; component (A) includes a concentration of each of subcomponents (A.1) and (A.2), and the concentration of (A.2) has a ratio to the concentration of (A.1) that is from about 0.06:1.0 to about 0.60:1.0; the concentration of component (B) is from about 0.45 to about 1.2 g/kg; and the concentration of component (B) has a ratio to the concentration of component (A) that is from about 0.016:1.0 to about 0.15:1.0.

8. A process according to claim 7 wherein, in the aqueous liquid composition: subcomponent (A.1) is selected from the group consisting of: (A.1.1) (A.1.1.1) block co-polymers of propylene oxide and ethylene oxide, (A.1.1.2) ethoxylated and both ethoxylated and propoxylated fatty alcohols, (A.1.1.3) ethoxylated and both ethoxylated and propoxylated alkyl phenols, and (A.1.1.4) ethoxylated alkyl or aryl moieties, all of which constituents of sub-subcomponent (A.1.1) optionally can be modified by capping a terminal ethoxy or propoxy group with a low molecular weight capping moiety having 1 to 4 carbon atoms; (A.1.2) neutral esters of a fatty acid and/or fatty alcohol that include a polyoxyethylene block in their molecular structure; (A.1.3) ethoxylated fatty amines; and (A.1.4) ethoxylated monoglycerides and diglycerides; the concentration of component (A) is from about 1.8 to about 7.5 g/kg; the concentration of (A.2) has a ratio to the concentration of (A.1) that is from about 0.10:1.0 to about 0.40:1.0; the concentration of component (B) is from about 0.075 to about 0.60 g/kg; and the concentration of component (B) has a ratio to the concentration of component (A) that is from about 0.024:1.0 to about 0.15:1.0.

9. A process according to claim 8 wherein: component (B) is selected from the group consisting of N-alkyl-2-pyrrolidones in which the alkyl group has from 2 to 20 carbon atoms; the concentration of component (A) is from about 2.4 to about 6.0 g/kg; and the concentration of component (B) has a ratio to the concentration of component (A) that is from about 0.024:1.0 to about 0.090:1.0.

10. A process according to claim 9 wherein the aqueous liquid composition has a pH value of at least about 9.3 and additionally comprises alkaline inorganic builders selected from the group consisting of alkali metal hydroxides, alkali metal silicates, alkali metal borates, alkali metal carbonates, alkali metal sulfates, alkali metal polyphosphates, alkali metal phosphates, alkali metal orthophosphates, and alkali metal pyrophosphates.

11. A process according to claim 10, wherein the aqueous liquid composition has a pH value of at least about 11.3 and comprises alkali metal silicates.

12. A process according to claim 9 wherein the aqueous liquid composition has a pH value from about 4.0 to about 6.9 and additionally comprises a molar concentration of a subcomponent (C.1) selected from the group consisting of alkali metal salts of boric acids and condensed boric acids and a molar concentration of a subcomponent (C.2) selected from the group consisting of free boric acids and condensed boric acids.

13. A process according to claim 12 wherein, in the aqueous liquid composition: the molar concentration of subcomponent (C.1) is at least about 1.8 mM/kg; the molar concentration of subcomponent (C.2) has a ratio to the molar concentration of subcomponent (C.1) that is from about 0.80:1.0 to about 2.5:1.0; and the pH value is from about 4.6 to about 5.9.

14. A process according to claim 13 wherein, in the aqueous liquid composition: subcomponent (C.2) is orthoboric acid and subcomponent (C.1) consists of potassium salts of orthoboric acid.

15. A process according to claim 14, wherein, in the aqueous liquid composition: the pH value is from about 5.10 to about 5.50; subcomponent (A.1) is selected from the group of molecules conforming to the general formula $R^4$—$(C_2H_4O)_w$—$R^5$, where $R^4$ represents an alkyl moiety having from 9 to 12 carbon atoms, $R^5$ represents hydrogen or an alkyl moiety having no more than 2 carbon atoms; and w is a number having an average value from about 6.0 to about 11.0, 10.0, 9.6, or 9.3; the concentration of component (A) is from about 3.0 to about 5.5 g/kg; the concentration of (A.2) has a ratio to the concentration of (A.1) that is from about 0.170:1.0 to about 0.30:1.0; component (B) is selected from the group consisting of N-alkyl-2-pyrrolidones in which the alkyl group has from 6 to 10 carbon atoms; the concentration of component (B) is from about 0.10 to about 0.21 g/kg; the concentration of component (B) has a ratio to the concentration of component (A) that is from about 0.035:1.0 to about 0.060:1.0; the molar concentration of subcomponent (C.1) is from about 0.003 to about 0.006 M/kg; and the molar concentration of subcomponent (C.2) has a ratio to the molar concentration of subcomponent (C.1) that is from about 1.00:1.0 to about 1.50:1.0.

16. A liquid composition of matter, suitable as such, after dilution with water, or both as such and after dilution with water, for aiding in the removal of soils from soiled metal workpiece surfaces by mass finishing, said liquid composition comprising water and:

(A) a concentration of a component selected from the group consisting of:

(A.1) nonionic surfactant molecules that contain a moiety with the chemical formula —$(C_mH_{(2m-z)}X_zO)_v$—, wherein m has the value 2, 3, or 4; z represents an integer with a value from 0 to 2m; X represents a halogen atom, and if z has a value of more than 1, may represent the same or a different halogen atom for each X; and v represents a positive integer; and (A.2) anionic, amphoteric, and both anionic and amphoteric alkali stable surfactants;

(B) a concentration of a component selected from the group consisting of molecules, exclusive of molecules that are part of component (A), that include a moiety corresponding to general chemical formula I:

(I)

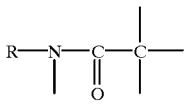

wherein R represents a monovalent aliphatic moiety with the chemical formula —$C_nH_{(2n+1-y)}F_y$, wherein n is an integer from 6 to 22, and y is an integer from 0 to (2n+1);

wherein the concentration of component (A) is at least about 40 g/kg, component (A) includes a concentration of each of subcomponents (A.1) and (A.2), and the concentration of (A.2) has a ratio to the concentration of (A.1) that is from about 0.06:1.0 to about 0.60:1.0, the concentration of component (B) is at least about 1.5 g/kg, and the concentration of component (B) has a ratio to the concentration of component (A) that is from about 0.016:1.0 to about 0.15:1.0;

wherein subcomponent (A.1) is selected from the group consisting of (A.1.1)(A.1.1.1) block copolymers of propylene oxide and ethylene oxide, (A.1.1.2) ethoxylated and both ethoxylated and propoxylated fatty alcohols, (A.1.1.3) ethoxylated and both ethoxylated and propoxylated alkyl phenols, and (A.1.1.4) ethoxylated alkyl or aryl moieties, all of which constituents of sub-subcomponent (A.1.1) optionally can be modified by capping a terminal ethoxy or propoxy group with a low molecular weight capping moiety having 1 to 4 carbon atoms, (A.1.2) neutral esters of a fatty acid and/or fatty alcohol that include a polyoxyethylene block in their molecular structure, (A.1.3) ethoxylated fatty amines, and (A.1.4) ethoxylated monoglycerides and diglycerides, the concentration of component (A) is at least about 60 g/kg, the concentration of (A.2) has a ratio to the concentration of (A.1) that is from about 0.10:1.0 to about 0.40:1.0, the concentration of component (B) is at least about 2.5 g/kg, and the concentration of component (B) has a ratio to the concentration of component (A) that is from about 0.024:1.0 to about 0.15:1.0;

wherein component (B) is selected from the group consisting of N-alkyl-2-pyrrolidones in which the alkyl group has from 2 to 20 carbon atoms; the concentration of component (A) is at least about 80 g/kg, and the concentration of component (B) has a ratio to the concentration of component (A) that is from about 0.024:1.0 to about 0.090:1.0;

wherein the composition additionally comprises alkaline inorganic builders selected from the group consisting of alkali metal hydroxides, alkali metal silicates, alkali metal borates, alkali metal carbonates, alkali metal sulfates, alkali metal polyphosphates, alkali metal phosphates, alkali metal orthophosphates, and alkali metal pyrophosphates, wherein at least one inorganic builder is an alkali metal silicate.

17. A liquid composition of matter, suitable as such, after dilution with water, or both as such and after dilution with water, for aiding in the removal of soils from soiled metal workpiece surfaces by mass finishing, said liquid composition comprising water and:

(A) a concentration of a component selected from the group consisting of:

(A.1) nonionic surfactant molecules that contain a moiety with the chemical formula —$(C_mH_{(2m-z)}X_zO)_v$—, wherein m has the value 2, 3, or 4; z represents an integer with a value from 0 to 2m; X represents a halogen atom, and if z has a value of more than 1, may represent the same or a different halogen atom for each X; and v represents a positive integer; and (A.2) anionic, amphoteric, and both anionic and amphoteric alkali stable surfactants;

(B) a concentration of a component selected from the group consisting of molecules, exclusive of molecules that are part of component (A), that include a moiety corresponding to general chemical formula I:

(I)

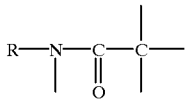

wherein R represents a monovalent aliphatic moiety with the chemical formula —$C_nH_{(2n+1-y)}F_y$, wherein n is an integer from 6 to 22, and y is an integer from 0 to (2n+1);

wherein the concentration of component (A) is at least about 40 g/kg, component (A) includes a concentration of each of subcomponents (A.1) and (A.2), and the concentration of (A.2) has a ratio to the concentration of (A.1) that is from about 0.06:1.0 to about 0.60:1.0, the concentration of component (B) is at least about 1.5 g/kg, and the concentration of component (B) has a ratio to the concentration of component (A) that is from about 0.016:1.0 to about 0.15:1.0;

wherein subcomponent (A.1) is selected from the group consisting of (A.1.1)(A.1.1.1) block copolymers of propylene oxide and ethylene oxide, (A.1.1.2) ethoxylated and both ethoxylated and propoxylated fatty alcohols, (A.1.1.3) ethoxylated and both ethoxylated and propoxylated alkyl phenols, and (A.1.1.4) ethoxylated alkyl or aryl moieties, all of which constituents of sub-subcomponent (A.1.1) optionally can be modified by capping a terminal ethoxy or propoxy group with a low molecular weight capping moiety having 1 to 4 carbon atoms, (A.1.2) neutral esters of a fatty acid and/or fatty alcohol that include a polyoxyethylene block in their molecular structure, (A.1.3) ethoxylated fatty amines, and (A.1.4) ethoxylated monoglycerides and diglycerides, the concentration of component (A) is at least about 60 g/kg, the concentration of (A.2) has a ratio to the concentration of (A.1) that is from about 0.10:1.0 to about 0.40:1.0, the concentration of component (B) is at least about 2.5 g/kg, and the concentration of component (B) has a ratio to the concentration of component (A) that is from about 0.024:1.0 to about 0.15:1.0;

wherein component (B) is selected from the group consisting of N-alkyl-2-pyrrolidones in which the alkyl group has from 2 to 20 carbon atoms; the concentration of component (A) is at least about 80 g/kg, and the concentration of component (B) has a ratio to the concentration of component (A) that is from about 0.024:1.0 to about 0.090:1.0; and wherein the composition is acidic and additionally comprises a molar concentration of a subcomponent (C.1) selected from the group consisting of alkali metal salts of boric acids and condensed boric acids and a molar concentration of a subcomponent (C.2) selected from the group consisting of free boric acids and condensed boric acids.

18. A composition according to claim 17, wherein: the molar concentration of subcomponent (C. 1) is at least about 60 mM/kg and the molar concentration of subcomponent (C.2) has a ratio to the molar concentration of subcomponent (C.1) that is from about 0.80:1.0 to about 2.5:1.0.

19. A composition according to claim 18, wherein: subcomponent (C.2) is orthoboric acid and subcomponent (C.1) consists of potassium salts of orthoboric acid.

20. A composition according to claim 19, wherein: subcomponent (A.1) is selected from the group of molecules conforming to the general formula $R^4$—$(C_2H_4O)_w$—$R^5$, where $R^4$ represents an alkyl moiety having from 9 to 12 carbon atoms, $R^5$ represents hydrogen or an alkyl moiety having no more than 2 carbon atoms; and w is a number having an average value from about 6.0 to about 11.0, 10.0, 9.6, or 9.3; the concentration of—component (A) is from about 100 to about 185 g/kg; the concentration of (A.2) has a ratio to the concentration of (A.1) that is from about 0.170:1.0 to about 0.30:1.0; component (B) is selected from the group consisting of N-alkyl-2-pyrrolidones in which the alkyl group has from 6 to 10 carbon atoms; the concentration of component (B) is from about 3.5 to about 7 g/kg; the concentration of component (B) has a ratio to the concentration of component (A) that is from about 0.035:1.0 to about 0.060:1.0; the molar concentration of subcomponent (C.1) is from about 0.100 to about 0.20 M/kg; and the molar concentration of subcomponent (C.2) has a ratio to the molar concentration of subcomponent (C.1) that is from about 1.00:1.0 to about 1.50:1.0.

* * * * *

UNITED STATES PATENT AND TRADEMARK OFFICE

CERTIFICATE OF CORRECTION

PATENT NO. : 6,211,132 B1
DATED : April 3, 2001
INVENTOR(S) : Pierce et al.

It is certified that error appears in the above-identified patent and that said Letters Patent is hereby corrected as shown below:

Column 12,
Line 33, after "from", delete "C", and insert therefor -- 0 --.

Column 13,
Line 17, after "claim 1", delete ",".
Line 18, after "claim 6", insert -- , --.
Line 28, after "claim 7", insert -- , --.
Line 50, after "claim 8", insert -- , --.

Column 14,
Line 10, after "claim 12", insert -- , --.
Line 17, after "claim 13", insert -- , --.

Signed and Sealed this

Twenty-third Day of December, 2003

JAMES E. ROGAN
*Director of the United States Patent and Trademark Office*